United States Patent [19]

Petrovich

[11] Patent Number: 4,625,610

[45] Date of Patent: Dec. 2, 1986

[54] CUTTING CHAIN HAVING AUTOMATIC SHARPENING

[75] Inventor: Michael V. Petrovich, Portland, Oreg.

[73] Assignee: Omark Industries, Inc., Portland, Oreg.

[21] Appl. No.: 794,706

[22] Filed: Nov. 4, 1985

[51] Int. Cl.[4] ..... B27B 33/14

[52] U.S. Cl. ..... 83/834; 83/833

[58] Field of Search ..... 83/833, 834, 830

[56] References Cited

U.S. PATENT DOCUMENTS

| | | | |
|---|---|---|---|
| 2,558,678 | 6/1951 | Garrett | 83/834 |
| 2,976,900 | 3/1961 | Mills | 83/834 |
| 3,170,497 | 2/1965 | Ehlen et al. | 83/833 |
| 3,545,508 | 12/1970 | Tupper | 83/833 |
| 4,348,926 | 9/1982 | Dolata et al. | 83/833 |

*Primary Examiner*—Donald R. Schran

*Attorney, Agent, or Firm*—Robert L. Harrington

[57] ABSTRACT

An automatically sharpenable saw chain cutting link having primary and secondary depth gauge elements. The primary depth gauge element controls the penetration of the top plate cutting edge into a kerf and is positioned a greater distance forward of the center of the cutting link than the top plate cutting edge is rearward of the center of the cutting link as required for automatic sharpening. The secondary depth gauge element is positioned adjacent the side plate cutting edge in the front to back and lateral directions but below the top plate cutting edge to avoid interference of the automatic sharpening function.

4 Claims, 7 Drawing Figures

FIG. 2
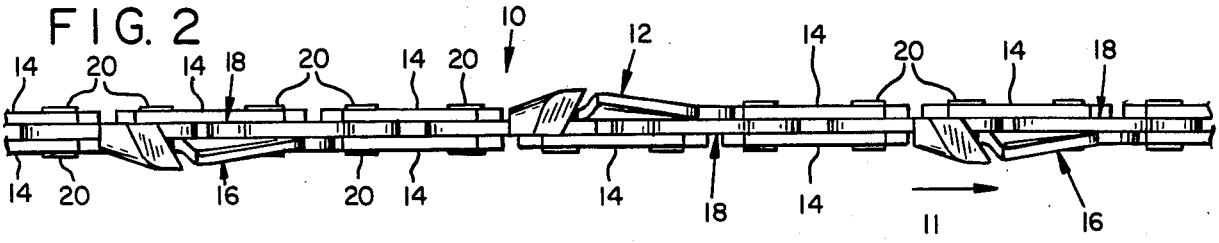
FIG. 1
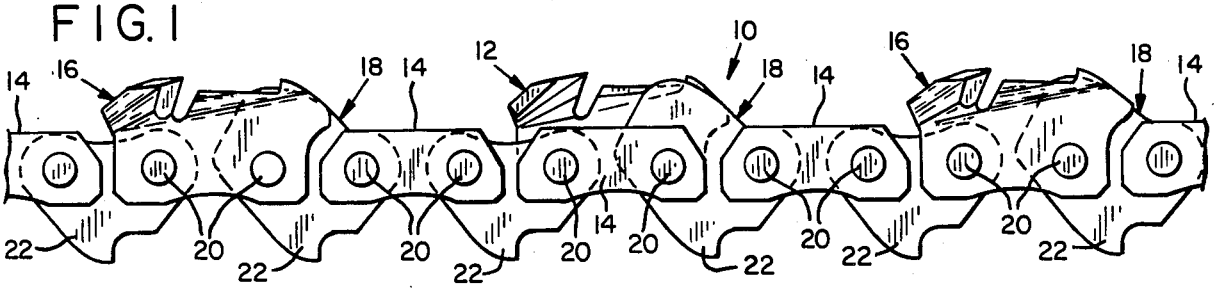
FIG. 7
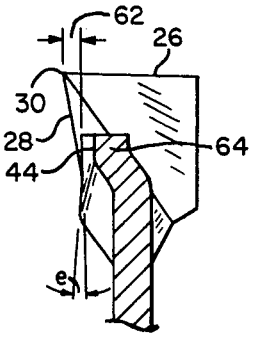
FIG. 3
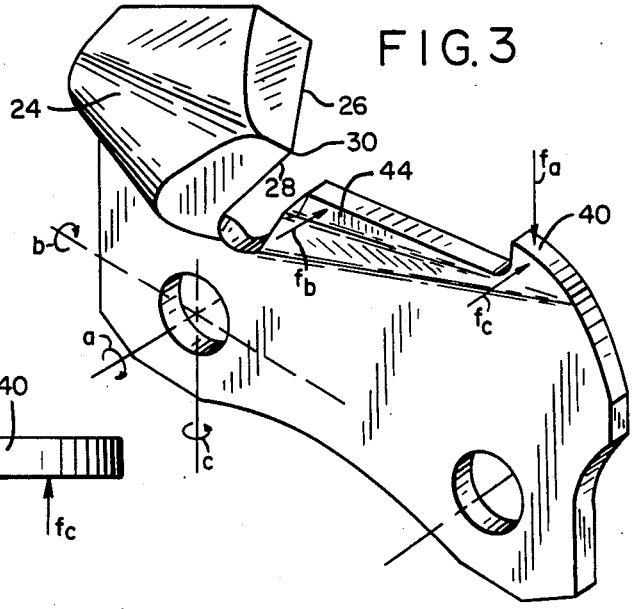
FIG. 4
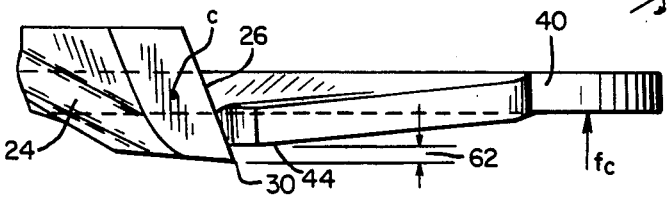
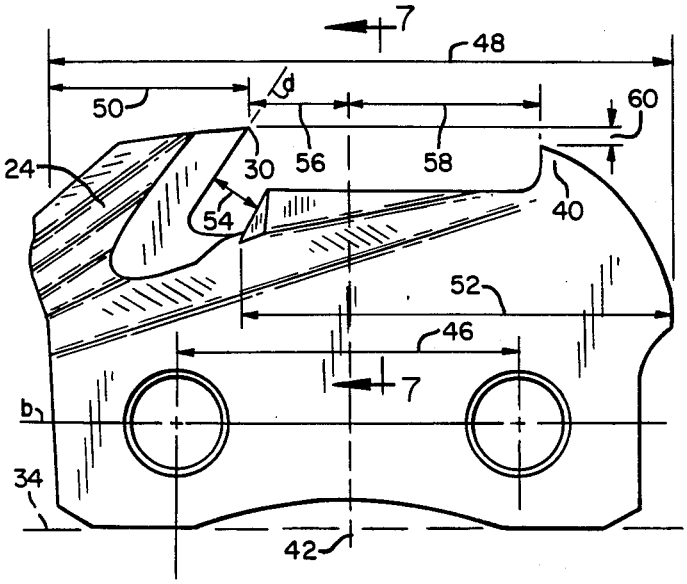
FIG. 6
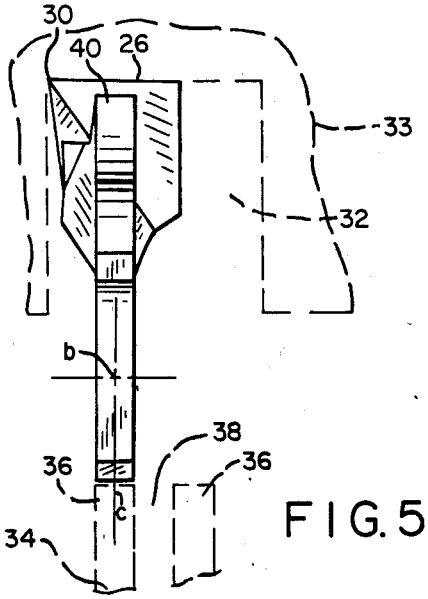
FIG. 5

CUTTING CHAIN HAVING AUTOMATIC SHARPENING

FIELD OF INVENTION

This invention relates to a cutting chain design adapted for automatic sharpening and more particularly to an automatically sharpenable cutting chain having a depth gauge feature that restricts kick back.

BACKGROUND OF INVENTION

In a prior development, it was discovered that the tendency of a cutting chain to kick back can be dramatically reduced by modifying the configuration of a top sharpenable cutting link. The depth gauge provided on the cutting link is twisted outwardly, front to back, and extended back to a point adjacent the leading cutting point i.e. just forward of the cutting point, just inside the side plate cutting edge and just below the top plate cutting edge. (See U.S. application Ser. No. 600,005; Filed: 4/13/84, by Gibson et al and assigned to the assignee of this application).

The improved depth gauge of the Gibson development can only be utilized for saw chain cutting links designed to be top sharpened in that the more conventional type of saw chain cutting links are designed to be sharpened by inserting a file between the cutting edge and the depth gauge, thus requiring a substantial spacing between the depth gauge and the leading cutting point. Top sharpenable chain does not require the spacing between the depth gauge and cutting edges for sharpening, and thus can be modified to include the improved depth gauge. However, top sharpenable chain designs are primarily useful as an automatically sharpenable chain and such automatic sharpening does require a spacing between the cutting edge and depth gauge. Gibson's development eliminated the very desirable feature of top sharpenable chains.

BRIEF DESCRIPTION OF THE INVENTION

It is an object of the present invention to provide a top sharpenable cutting link that substantially achieves the beneficial depth gauge feature of reduced kick back (as provided in the Gibson development), but improving that feature in a manner that allows automatic sharpening.

Very briefly, the improved cutting link of this invention is provided with primary and secondary depth gauge elements. The primary element of the depth gauge is positioned at a height to control inward penetration, and the secondary element is positioned laterally outwardly near the side plate cutting edge to control sideward penetration. As will be subsequently explained, control of sideward penetration requires close proximity of the secondary element to the side plate cutting edge. However, the inward penetration of the top plate cutting edge can be controlled with a susbstantial spacing of the primary depth gauge element forward of the top plate cutting edge. By separating the depth gauge into dual elements having independent functions, they can be designed into a top sharpening cutting link in a manner that permits the inclusion of the desired automatic sharpening feature. A greater understanding of the invention will be derived by reference to the detailed description and drawings that follow.

DETAILED DESCRIPTION AND DRAWINGS

The drawing figures are briefly described as follows:

FIG. 1 is a side view of a length of cutting chain in accordance with the invention;

FIG. 2 is a top view of the length of cutting chain shown in FIG. 1;

FIG. 3 is a perspective view of a right hand cutting link from the cutting chain of FIG. 1;

FIG. 4 is a top view of the cutting link of FIG. 3;

FIG. 5 is a front view of the cutting link of FIG. 3;

FIG. 6 is a side view of the cutting link of FIG. 3; and

FIG. 7 is a sectional view taken on view lines 7—7 of FIG. 6.

Reference is made to FIGS. 1 and 2 wherein a length of cutting chain is illustrated. A cutting chain 10 is designed to cut into and through wood materials such as a log or standing tree. The cutting direction is indicated in drawing 2 by arrow 11. The cutting chain 10 is made up of a series of articulated links. These links include left and right hand cutting links 12 and 16, side links 14 (sometimes referred to as tie straps) and center or drive links 18. These links are all pivotally interconnected by rivets 20. The cutting chain is designed for circular travel around the edge of a guide bar 34, confined on the guide bar by tangs 22 riding in a groove 38, with the bottom edges of links 12, 14, 16 riding on guide rails 36 formed into the edge of the guide bar 34 (see FIG. 5).

Reference is now made to FIGS. 3 thru 6 illustrating one of the cutting links i.e. a right hand cutting link 16. The cutting head 24 of link 16 has a top plate cutting edge 26 and a side plate cutting edge 28. Cutting edges 26 and 28 are angled forwardly and intersect at a leading cutting point 30. Note from FIG. 5 that the side plate cutting edge 28 and top plate cutting edge 26 cooperate to sever and remove wood fibers to form (along with the cutting edges of cutting link 12) a kerf 32 in the wood material 33 e.g. a log or tree.

Due to the articulation of the pivotally connected links and the various forces acting on the cutting head 24, some pivoting about axis a and axis b is generated as the cutting edges 26 and 28 cut into and through the wood material. Such pivoting changes the orientation of the cutting edges and under the right circumstances, will cause the unwanted digging in that produces kick back.

Previously a single depth gauge element was provided to reduce the ability of the cutting link to pivot about axis a. Gibson learned however, that the effect of pivoting about axis b could be dramatically reduced by locating the depth gauge element closely adjacent to cutting point 30. The depth gauge height is thus provided close to the height of cutting edge 26 and prevents digging in of cutting edges 26, and it is also close to the lateral position of edge 28 and thus prevents digging in of cutting edge 28. In addition to the need for height and lateral proximity to cutting point 30, it was learned that a front to back promixity was also required. Thus the prior Gibson design evolved which achieved the objective of safety but only at the sacrifice of automatic sharpening.

The present invention has evolved from an appreciation of the forces acting against a depth gauge that functions to control digging-in of both the cutting edges 26 and 28. Referring specifically to FIGS. 3, 5 and 6, it will be appreciated that a height controlling depth gauge positioned well forward of cutting edge 26 will restrict pivoting of the cutting link about axis a. Note from FIG. 6 the reactive force $f_a$ acting against the depth gauge to prevent the front end of the link from lifting off the bar rail 36, thereby maintaining the orientation of cutting edge 26 relative to the kerf 32 in the wood material 33. However, a lateral depth gauge at the same position will restrict pivoting of the cutting link about one or the other of axis b or axis c, but not both (see force $f_c$ applied in FIGS. 3, 4 and 5, and here the reader must consider that the depth gauge at the position of force $f_c$ is laterally offset to bear against the side wall of the kerf 32).

If the cutting link is permitted to pivot about axis b, the cutting point 30 and cutting edge 28 can and will become oriented to occasionally dig in and generate kick back, thus the reason for the close proximity, front to back, of the Gibson depth gauge. A further negative result of the force $f_c$ acting about axis c is that the orientation of the cutting edge becomes inwardly directed and the kerf width will tend to narrow. The width of the kerf established by the cutting edges 28 on the left and right hand cutting links and its counterpart side plate cutting edge on the left hand cutting link is necessary to insure clearance for the chain and bar which follows the cutting edges into the kerf. A too narrow kerf width will result in a pinching of the chain and bar which can also cause kick back and certainly damage to the bar and chain.

The present invention proposes a solution to the problem by providing dual depth gauge elements. As illustrated in FIGS. 3 thru 6, a primary depth gauge element 40 (the height controlling element that controls pivoting about axis a), is spaced forwardly of the cutting edge 26 as desired for automatic sharpening, i.e. a distance forwardly of center line 42 that is greater than the distance cutting edge 26 is rearward of center line 42. (See U.S. Pat. No. 3,183,948 for a more thorough explanation of automatic sharpening). A secondary depth gauge 44 is provided closely proximate to cutting edge 28 (in both the front to back and lateral direction) but is spaced below cutting point 30 and cutting edge 26 so as to avoid interference with automatic sharpening. At this position and as illustrated by force line $f_b$ the reactive and protective force of $f_b$ is applied substantially closer to axis c (as compared to force $f_c$) where the leverage of force $f_b$ favors pivotal resistance about axis b rather than axis c. Thus pivoting of the cutting link about axis b is substantially prevented and digging into the kerf side wall by cutting edges 26 and cutting point 30 is substantially avoided.

SPECIFICATIONS OF THE PREFERRED EMBODIMENT

A cutting link of the present invention which has been produced and successfully tested is a 0.390 inch pitch cutting link (distance 46 between centers of rivot holes) having an overall length 48 of about 0.710 inch. The cutting head has a length 50 of about 0.25 inch and the depth gauge a length 52 of about 0.50 inch (greater than half the cutting link length). Angle d (the backward slope of cutting edge 28) is about 35°, distance 56 (chain link center 42 to cutting point 30) is about 0.12 inch and distance 58 (chain link center to tip of element 40) is about 0.55 inch. The height differential 60 between cutting point 30 and the tip of the depth gauge element 40 (the top plate depth gauge setting) is about 0.015 inch.

The above general dimensions are suitable for automatic sharpening as generally taught by the disclosure of U.S. Pat. No. 3,183,948 wherein a sharpening stone placed at the end of the guide bar (i.e. where the chain travels in a semi-circular path) will grind off both the cutting edge 26 and tip of the depth gauge element 40 to maintain the desired depth gauge setting 60. (Such automatic sharpening is not permitted in accordance with the Gibson et al teachings in U.S. patent application Ser. No. 600,005.)

To provide the further safety feature that equates the present invention to that of Gibson, the secondary depth gauge element 44 is provided by extending the depth gauge forward of element 40 at a reduced height (e.g. 0.050 inch below the height of element 40) to a position (front to back) just short of cutting edge 28 (a distance 54 of about 0.06 inches). Reference is made to FIGS. 4, 5 and 7 wherein the extended depth gauge element 44 is shown to be twisted outwardly from element 40, to position the rearward most point of element 44 (where force $f_b$ is generally applied) a lateral distance 62 from the cutting point 30 of about 0.010 inch.

Whereas element 44 is provided to limit lateral penetration of cutting edge 28 (preceded by point 30) it has been found desirable to twist element 44 in a manner that provides a generally flat surface 64 that substantially parallels the kerf wall (see FIG. 5). In this specific embodiment, the flat surface 64 is provided with relief angles (up and down, and front to back) to about 4° i.e. angles e and f in FIGS. 4 and 7.

It is to be understood that the above specific description of the preferred embodiment is provided by way of example only and it is contemplated that variations and modifications will become apparent to those skilled in the art without departing from the inventive concept as defined in the claims appended hereto.

I claim:

1. A saw chain cutting link comprising; a body portion having top, bottom, front and back edges, a cutting head extending upwardly from the top edge rearward of a center line bisecting the body portion front to back, and a depth gauge extending upwardly from the top edge position forwardly of the cutting head;

said cutting head formed into a hooded cutting head having a side plate extending upwardly from the body portion along one side of the body portion and a top plate extended from the side plate over the body portion, a top plate cutting edge forming the leading edge of said top plate, and a side plate cutting edge forming the leading edge of said side plate, and a cutting point formed by the intersection of the top plate cutting edge and the side plate cutting edge, said cutting point being the outer most point of said hooded cutting head both upwardly and laterally of said one side, and said cutting point being the forward most point of said top and side plate cutting edges;

primary and secondary elements forming said depth gauge, said primary element projected upwardly from the top edge of the body portion to an upper most position forwardly of the center line a distance greater than the distance of the cutting point of said cutting head is rearward of said center line, said upward extension of the primary element terminating at an upper position just short of the upper position of the cutting point to provide thereby a depth gauge setting for the top plate cutting edge that is maintainable by an automatic sharpening function, and said secondary element projected upwardly from the top edge of the body portion and laterally from said one side to terminate at a position substantially adjacent the side plate cutting edge in a direction front to back, and just laterally short of the cutting point to provide thereby a depth gauge setting for the side plate cutting edge, said secondary element being recessed below the cutting point and upper extension of the primary element to avoid interference of the automatic sharpening function.

2. A saw chain cutting link as defined in claim 1 wherein said secondary element is angled laterally to said one side and rearwardly from said primary element to form a surface area adjacent the side plate cutting edge for limiting penetration of the side plate cutting edge into the side wall of a kerf being cut.

3. A saw chain cutting link adapted for automatic sharpening comprising; a body portion, said body portion having forward and rearward rivet receiving openings, a hooded cutting head portionlocated substantially over the rear rivet receiving opening, and a depth gauge portion located forward of the cutting head portion, said hooded cutting head portion having a top sharpenable cutting edge and a side sharpenable cutting edge intersecting at a cutting corner, said cutting corner being the outer most point of the cutting head portion upwardly and outwardly of one side of the cutting link, said cutting edges angled rearwardly from the cutting point whereby the cutting point forms the forward most point of the cutting edges, a primary depth gauge element projected upwardly to a position substantially over the front rivet receiving opening and positioned forwardly of a center line between the rivet receiving openings a distance greater than the distance of the cutting point rearward of said center line, and said primary depth gauge element projected upwardly to a height less than the height of the cutting corner and establishing thereby a depth gauge setting for the top plate cutting edge that is maintainable by directing the cutting link around a semi-circular path to engage a sharpening stone projected in the semi-circular path for automatic sharpening; and the improvement that comprises;

a secondary depth gauge element substantially adjacent the cutting corner in a front to back and lateral directions, and substantially below the height of the top plate cutting edge, said lateral adjacency established to provide a lateral depth gauge setting for the side plate cutting edge, and said spacing below the height of the top plate cutting edge established to avoid interference of the automatic sharpening functioning.

4. A saw chain cutting link as defined in claim 3 wherein the the secondary element is spaced front to back substantially closer to the rear rivet receiving opening then to the front rivet receiving opening.

* * * * *